US007779582B1

(12) United States Patent
Green

(10) Patent No.: US 7,779,582 B1
(45) Date of Patent: Aug. 24, 2010

(54) STAIRWAY SYSTEM

(75) Inventor: Robert H. Green, Lenoir, NC (US)

(73) Assignee: ECMD, Inc., North Wilkesboro, NC (US)

( * ) Notice: Subject to any disclaimer, the term of this patent is extended or adjusted under 35 U.S.C. 154(b) by 0 days.

(21) Appl. No.: 12/206,202

(22) Filed: Sep. 8, 2008

Related U.S. Application Data

(63) Continuation of application No. 10/860,173, filed on Jun. 3, 2004, now Pat. No. 7,421,824, which is a continuation of application No. 09/855,635, filed on May 14, 2001, now Pat. No. 6,769,221.

(51) Int. Cl.
*E04F 11/00* (2006.01)
*E04C 3/30* (2006.01)

(52) U.S. Cl. ..... 52/182; 52/832

(58) Field of Classification Search ..... 52/182, 52/188, 832, 187; 256/65.02
See application file for complete search history.

(56) References Cited

U.S. PATENT DOCUMENTS

| | | | | |
|---|---|---|---|---|
| 3,393,481 | A | 7/1968 | Meuret | 52/188 |
| 4,367,864 | A | 1/1983 | Eldeen | 256/59 |
| 4,386,761 | A | 6/1983 | Kato | 256/21 |
| 4,587,788 | A | 5/1986 | Bielicki | 52/698 |
| 5,035,401 | A | 7/1991 | Solter | 256/19 |
| 5,095,668 | A | 3/1992 | O'Brien et al. | 52/184 |
| 5,261,201 | A | 11/1993 | Smith | 52/184 |
| 5,309,687 | A | 5/1994 | Walston | 52/187 |
| 5,419,538 | A | 5/1995 | Nicholas et al. | 256/65 |
| 5,737,884 | A | 4/1998 | Schrom | 52/187 |
| 6,015,138 | A | 1/2000 | Kohlberger et al. | 256/65.14 |
| 6,115,975 | A | 9/2000 | Abdollahi | 52/179 |
| 6,125,598 | A | 10/2000 | Lanphier | 52/182 |
| 6,141,928 | A | 11/2000 | Platt | 52/296 |
| 6,290,212 | B1 | 9/2001 | Bartel | 256/65.14 |
| 6,568,145 | B2 | 5/2003 | Bartel | 52/741.2 |

OTHER PUBLICATIONS

Coffman Catalog; copyright 1995.
L.J. Smith Catalog; copyright 1997.
Creative Stairparts; copyright 1998.
Horner Architectural Products Catalog; copyright 2000.
Crown Heritage Stair Systems Catalog; copyright 2000.
Sheraton Catalog; undated related technology.
Letter of Isaac P. Espy dated Oct. 6, 2006.

*Primary Examiner*—Milton Nelson, Jr.
(74) *Attorney, Agent, or Firm*—MacCord Mason PLLC

(57) ABSTRACT

A stairway system is disclosed that includes a plurality of spaced apart treads; a handrail; and at least two balusters per tread. Each baluster includes a top length segment, a bottom length segment and a turning length segment, the turning length segment including a defined feature. According to the present invention, the turning length segment of each subsequent baluster is greater than the turning length segment of the previous baluster according to the equation of the riser height divided by the total number of balusters. Thus, each feature in the bottom length segment of each of the balusters align with the tread for each baluster. In the preferred embodiment, only four different baluster lengths are necessary for both two and three balusters per tread.

1 Claim, 8 Drawing Sheets

TURNING LENGTH "TL"-2
BALUSTERS PER TREAD 3 3/4
7 1/2
UNITS
RISER HEIGHT "RH"
$T_nL_o$
15 UNITS TREAD DEPTH "D"

TL-3 BALUSTERS PER TREAD 2 1/2
5
7 1/2 RH
$T_nL_o$
15 D

TL-4 BALUSTERS PER TREAD 1 7/8
3 3/4
5 5/8
7 1/2 RH
$T_nL_o$
15 D

TL-5 BALUSTERS PER TREAD 1 1/2
3
4 1/2
6
7 1/2 RH
$T_nL_o$
15 D

TL-6 BALUSTERS PER TREAD 1 1/4
2 1/2
3 3/4
5
6 1/4
7 1/2 RH
$T_nL_o$
15 D

STAIRWAY SYSTEM

This application is a continuation of application Ser. No. 10/860,173 filed Jun. 3, 2004, now U.S. Pat. No. 7,421,824, issued Sep. 9, 2008, which is a continuation of application Ser. No. 09/855,635 filed May 14, 2001, now U.S. Pat. No. 6,769,221 issued Aug. 3, 2004.

BACKGROUND OF THE INVENTION (1) Field of the Invention

The present invention relates generally to stairways and, more particularly, to a stairway system that provides a series of balusters, which include features which align with both the tread and the handrail.

(2) Description of the Prior Art

In stairway systems, the aesthetic aspects of the alignment of features on the baluster with the treads and the handrail were traditionally done through custom carpentry. In such cases, each baluster was custom hand crafted to create the alignment of the bottom features of each baluster with the tread surface while the top feature of each baluster aligned with the slope of the handrail. To accomplish this alignment each baluster component was hand crafted by a craftsman.

Although still possible today, it is prohibitively expensive for most construction and therefore rarely done. To make such features available at a reasonable cost requires the ability to create a system that allows for only the most limited number of balusters to be manufactured and maintained in inventory, which can be selected to achieve the desired alignment between both the tread and the handrail.

To date such a system has eluded the mass manufacturing industry. For example, some systems have been able to align features within a baluster with the handrail or alternatively with the tread; however, none have provided both features without custom manufacturing. In a tapered baluster system having a gradual tapers or small diameters pin tops it may deceptively appear that features have been aligned with both the handrail and the tread; however, this deception is revealed in tapered balusters having steeper tapers and larger diameter pin tops that show that the feature does not align with the hand rail when aligned with the tread.

Thus, there remains a need for a new and improved stairway system which provides a series of balusters which include features that align both with the tread and the handrail while, at the same time, minimize the number of baluster lengths within an inventory.

SUMMARY OF THE INVENTION

The present invention is directed to a stairway system, which includes a plurality of spaced apart treads; a handrail; and at least two balusters per tread. Each baluster includes a top length segment, a bottom length segment and a turning length segment, the turning length segment further includes a portion of defined features. According to the present invention, a length of the turning length segment of a subsequent baluster is greater than a length of the turning length segment of a previous baluster on the same tread according to the equation of the riser height divided by the total number of balusters (for example: 7½" riser÷2 balusters=3¾" or 7½" riser÷3 balusters=2½"). Thus, each of a portion of the defined features in the bottom length segment of each of the balusters align with the tread for each baluster on the same tread.

The stairway system also includes an upright lateral support for supporting the handrail. In the preferred embodiment, the upright lateral support is a newel. One end of the newel is connected to the handrail and the other end of the newel is anchored. Preferably, the newel is connected to the one end of the handrail.

Also, in the preferred embodiment, the newel is vertically anchored, such as to the floor of the structure or to at least one tread. The anchor includes a bolt and a mounting column, wherein one end of the bolt is a wood screw for attaching to the newel. The mounting column preferably further includes a mounting plate attached to the mounting column. The mounting plate may also include a plurality of apertures for receiving fasteners for attaching the plate to the floor of the structure.

The spaced apart treads include a foot support surface and means for attaching the foot support surface to the structure. The width of the foot support surface generally is greater than the depth of the foot support surface. In the preferred embodiment, the means for attaching the spaced apart treads to the structure is a stringer. However, the means for attaching the spaced apart treads to the structure may also be by wall mounting. For example, a stringer supporting the stairs may be attached directly to a wall or with a skirt board between the stringer and the wall.

In the preferred embodiment, each of the spaced apart treads is spaced at a uniform riser height, which may vary between about 6" and 9" with about 7½" being preferred.

Also, in the preferred embodiment, only four different baluster lengths are necessary for both two and three balusters per tread. In this case, the combined length of the top length segment, turning length segment and bottom length segment of each baluster is between 31" and 46". Specifically, the first of the four balusters is about 35", the second baluster is about 39", the third baluster is between 42" and 44", and there is a mid-size baluster between 35" and 39". In the most preferred embodiment, the mid-size baluster is about 37½" and the third baluster of between 42" and 44" is about 44".

Accordingly, one aspect of the present invention is to provide a stairway system, the stairway system including: a plurality of spaced apart treads; a handrail; and at least two balusters per tread, each baluster having a top length segment, a bottom length segment and a turning length segment, the turning length segment including a portion of defined features; wherein a length of the turning length segment of a subsequent baluster is greater than a length of the turning length segment of a previous baluster according to the equation of the riser height divided by the total number of balusters.

Another aspect of the present invention is to provide a stairway system having a plurality of spaced apart treads and a handrail, the improvement including at least two balusters per tread, each baluster having a top length segment, a bottom length segment and a turning length segment, the turning length segment including a portion of defined features; wherein a length of the turning length segment of a subsequent baluster is greater than a length of the turning length segment of a previous baluster according to the equation of the riser height divided by the total number of balusters, wherein each of a portion of the defined features in the bottom length segment of each of the balusters align with the tread for both two balusters and three balusters per tread using only four different baluster lengths.

Still another aspect of the present invention is to provide a stairway system, the stairway system including: a plurality of spaced apart treads; a handrail; at least two balusters per tread, each baluster having a top length segment, a bottom length segment and a turning length segment, the turning length segment including a portion of defined features; wherein a length of the turning length segment of a subsequent baluster is greater than a length of the turning length segment of a previous baluster according to the equation of the riser height divided by the total number of balusters, wherein each of a portion of the defined features in the bottom length segment of each of the balusters align with the tread for both two balusters and three balusters per tread using only four different baluster lengths; and an upright lateral support for supporting the handrail.

These and other aspects of the present invention will become apparent to those skilled in the art after a reading of the following description of the preferred embodiment when considered with the drawings.

DESCRIPTION OF THE PREFERRED EMBODIMENTS

Figure 1:
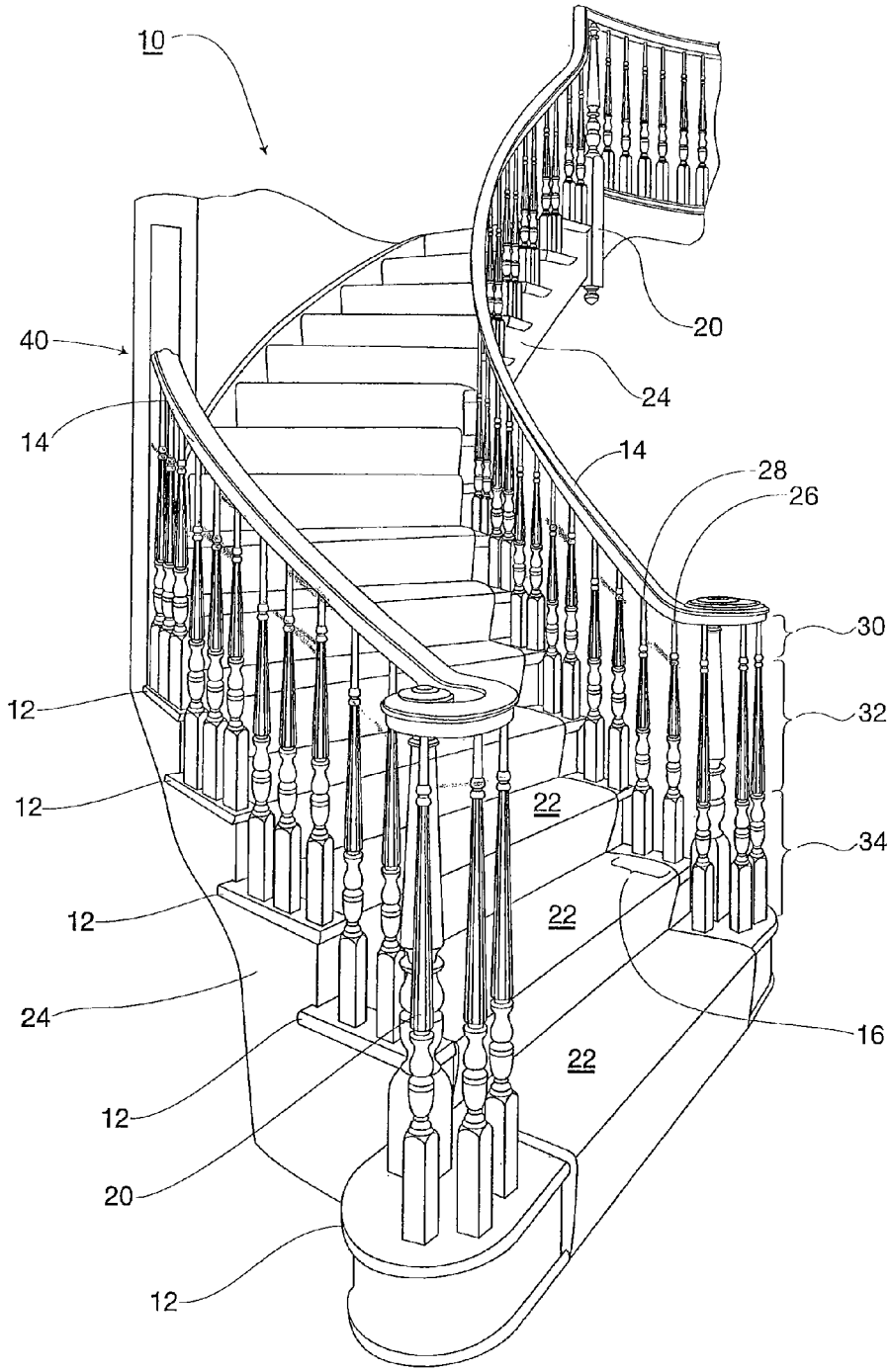
FIG. 1 is a stairway system constructed according to the present invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a stairway system, generally designated 10, is shown constructed according to the present invention. The stairway system 10 includes three major sub-assemblies: a plurality of spaced apart treads 12; a handrail 14; and at least two balusters per tread 16.

Figure 2:
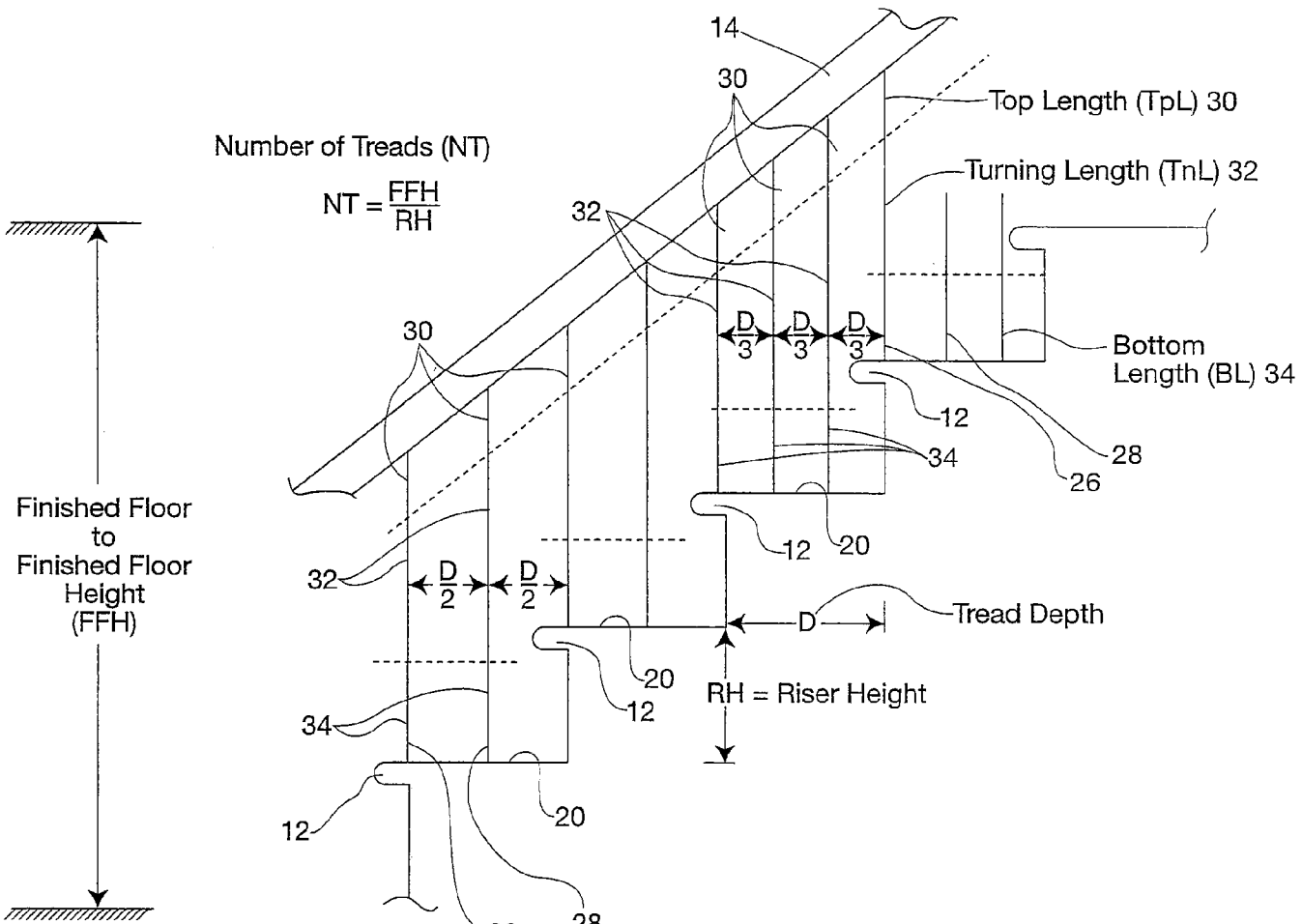
FIG. 2 is a schematic illustration of the stairway system of the present invention showing the placement of either two balusters per tread or three balusters per tread.

As may be seen in FIGS. 1 and 2, the at least two balusters 16 include a first baluster 26 and a second baluster 28. As may be seen in FIGS. 1, 2 and 5, each baluster includes a top length segment 30, a turning length segment 32 and a bottom length segment 34. The spaced treads 12 include a foot support surface 22. Typically, the width of the tread is greater than the depth (designated "D" in FIG. 2) of the tread. There is a means for attaching 24 the stairway system 10 to a structure. One means for attaching 24 the stairway system to a structure includes a stringer. Other means for attaching 24 the stairway system to a structure are wall supports or floor supports. The handrail 14 is separated from the spaced treads 12 by an upright lateral support 20. Various types of upright lateral supports might be included such as a newel or a baluster.

With respect to the at least two balusters 16, it is particularly desirable for portions of features 36 included in the bottom length segment 34 of adjacent balusters communicating with a common tread 12 to define a line segment that aligns with the foot support surface 22 of the tread 12 and portions of features 36 included in the top length segment 30 of adjacent balusters communicating with a common tread 12 as well as balusters communicating with adjacent treads 12 to define a line segment that aligns with the handrail slope. To accomplish this, it is desirable to incrementally change by an integer multiple of the ratio RH/N (where RH is the riser height and N is the number of balusters per tread relative) the length of the turning length segment 32 of the second baluster 28 and, if applicable, any subsequent balusters, relative to the length of the turning length segment 32 of the first baluster 26.

FIG. 2 sets out a method of determining the number of treads, NT, for a stairway system 10 given the finished floor to finished floor height, FFH, in a structure. The number of treads is dictated by the riser height (designated "RH" in FIGS. 2, 3A, 3B, and 4A-E). That is, NT=FFH/RH. Typically, the riser height, RH, is uniform and ranges from about 6" and about 9". Within the United States the riser height, RH, more typically is designated at about 7½". FIG. 2 shows configurations for a stairway system 10 having two balusters per tread and a stairway system 10 having three balusters per tread. To the lower left of FIG. 2 is shown the two baluster per tread configuration where the spacing between the balusters is the tread depth, D, divided by the number of balusters per tread, N=2. That is the spacing between the balusters is D/2. To the upper right of FIG. 2 is shown the three baluster per tread configuration. In this instance, the spacing between the balusters is D/3 or the tread depth, D, divided by the number of balusters, N=3. Each baluster in each stairway system 10 includes a top length segment 30, a turning length segment 32 and a bottom length segment 34. It is particularly desirable to have portions of features 36 included in the top length segment 30 to align from baluster to baluster and with the slope of the handrail 14 while portions of features 36 included in the bottom length segment 34 align from baluster to baluster and with the tread 12 with which the baluster communicate. To accomplish this, the length of the turning length segment 32 from one baluster to the next is incrementally changed in length, increment. Unexpectedly, the amount of incremental change, that is the increment, is not substantially dependent on the tread depth; however, it is only dependent on the number of balusters per tread. This is illustrated in FIGS. 3A and 3B.

In particular, a reference length of the turning length segment 32 is designated $T_nL_o$. In this case, such a length, $T_nL_o$, could be designated as being the length of the turning length segment 32 of the first baluster 26. Then the question arises whether the increment for the length of the turning length segment 32 changes when the tread depth, D, is changed. FIG. 3A illustrates an increment for the length of the turning length segment 32 in a two baluster per tread system (the upper illustration has a tread depth, D, of 15 units and a riser height, RH, of 7½ units). Since the balusters are equidistant, the increment for the length of the turning length segment 32 between the first baluster 26 and the second baluster 28 is 3¾ units. Stated differently, the increment for the length of the turning length segment 32 is an integral multiple of the riser height divided by the number of balusters per tread, RH/N. In the case where the tread depth is decreased by ½ (the lower illustration has a tread depth, D, of 7½ units and a riser height, RH, of 7½ units) the increment for the length of the turning length segment 32 remains 3¾ units or as stated earlier the riser height divided by the number of balusters per tread, RH/N={(7½ units)/(2 balusters per tread)}=3¾ units.

Figure 3B:
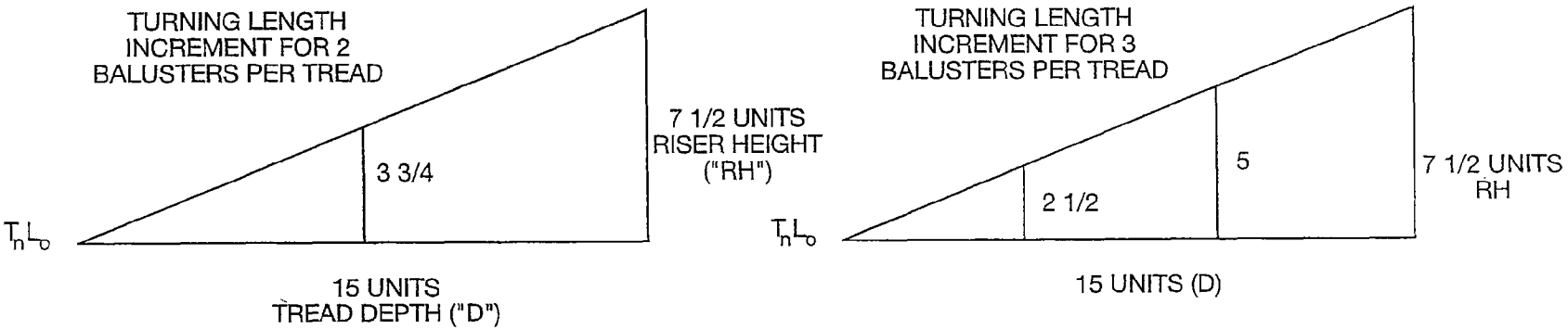
FIG. 3B is a schematic illustration of the turning length increment for a three baluster per tread system also showing independence with variable tread depth.
Figure 3B:
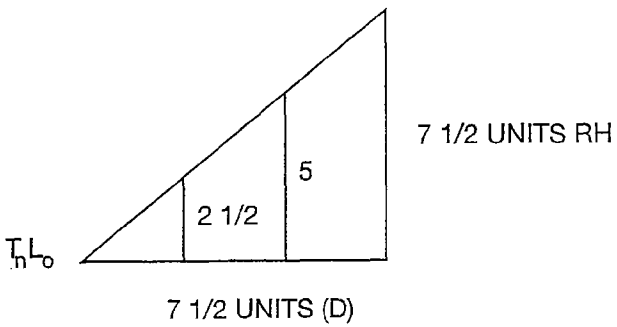
Figure 3A:
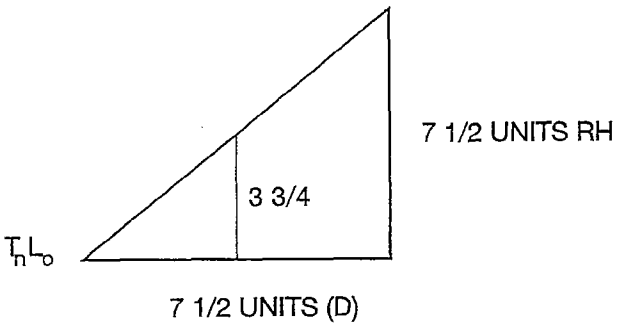
FIG. 3A is a schematic illustration of the turning length increment for a two baluster per tread system showing independence with variable tread depth.
Figure 4A:
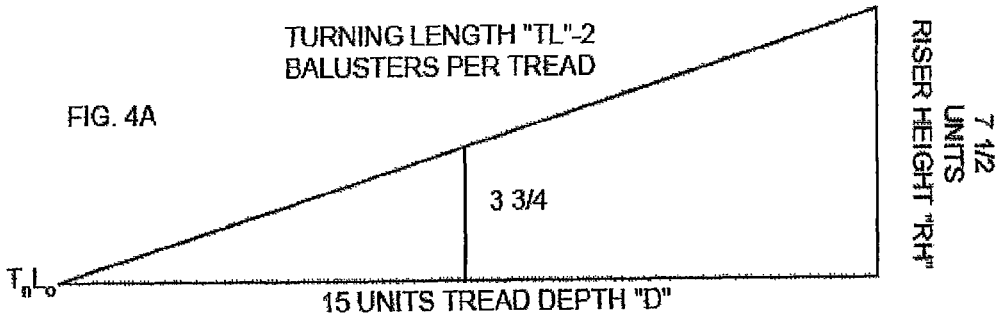
FIGS. 4A through 4E are turning length increments for systems having two to six balusters per tread.
Figure 4B:
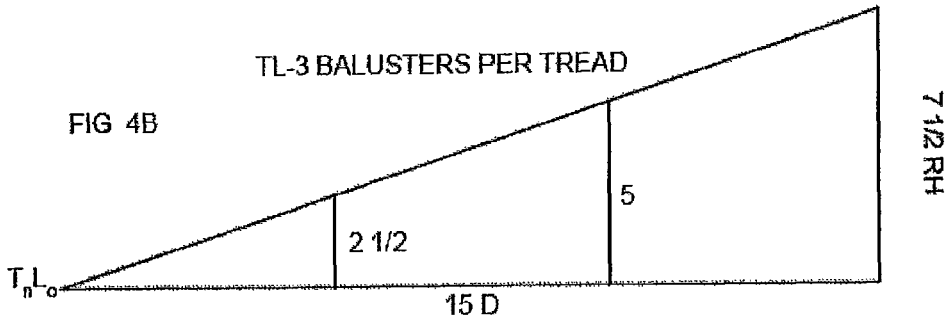
Figure 4C:
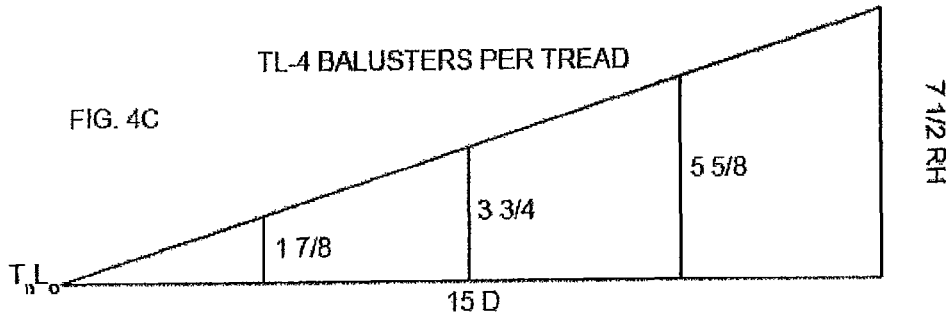
Figure 4D:
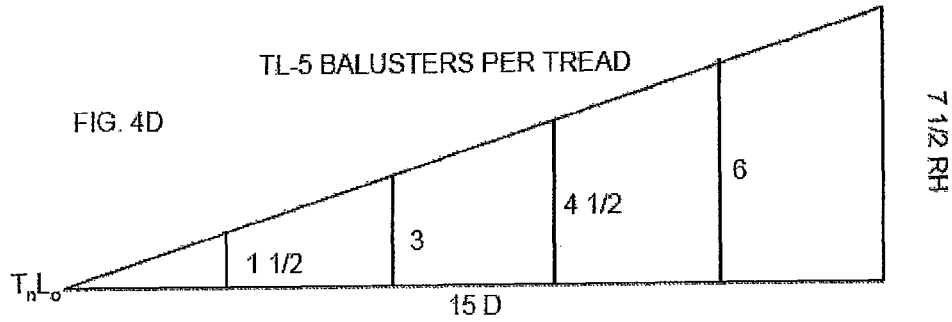
Figure 4E:
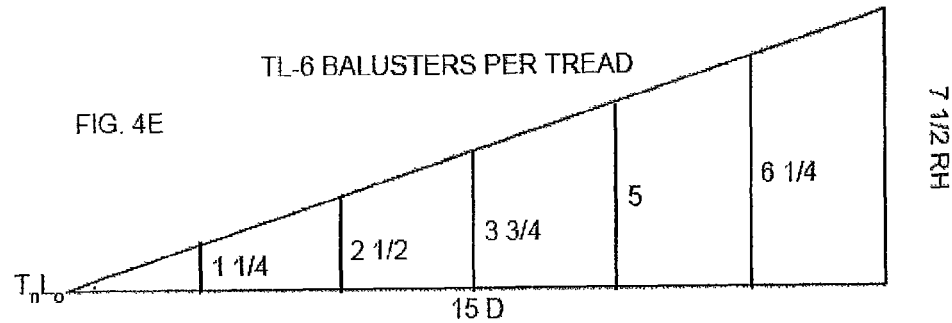

As a further illustration, FIG. 3B shows the increment for the length of the turning length segment 32 for a three balusters per tread system again with varying tread depths (the upper illustration has a tread depth, D, of 15 units and a riser height, RH, of 7½ units and the lower illustration has a tread depth, D, of 7½ units and a riser height, RH, of 7½ units). As with the two baluster per tread system, the increment for the length of the turning length segment 32 between the first, second and third balusters remains the same whether the tread depth, D, is 15 units or 7½ units. Thus, unexpectedly the increment for the length of the turning length segment 32 may not be a function of the tread depth, D, but only a function of the riser height, RH.

To create systems as depicted in FIG. 1, while minimizing the amount of inventory for accomplishing the alignment a portion of the features 36 with the foot support surface 22 and the slope of handrail 14, it is helpful to create diagrams of the baluster increments for the various systems. FIGS. 4A through 4E are illustrations of increments for the length of the turning length segment 32 for stairway systems 10 having 2, 3, 4, 5 and 6 balusters per tread. In each instance on the left hand side, the reference is taken as the first baluster having features 36 so the first turning length is $T_nL_o$.

To each reference length, $T_nL_o$, of the turning length segment 32, an increment is added as was previously discussed. To determine the minimum number of different baluster lengths needed to accommodate a two balusters per tread stairway system 10 and a three balusters per tread stairway system 10 there is always one reference baluster that is useable in the two baluster per tread stairway system 10 and the three baluster per tread stairway system 10.

Thus, according to the present invention, to be able to maintain an inventory that would allow the manufacture of a two baluster per tread stairway system 10 and a three baluster per tread stairway system 10, there must be a minimum of 4 different balusters of varying lengths. That is, there must be the reference baluster or the first baluster, a second baluster having an increment of 3¾ units for use in the two baluster per tread stairway system 10 and a third baluster having an increment of 2½ units for use in the three baluster per tread stairway system 10 as well as a fourth baluster having an increment of 5 units for the three baluster per tread stairway system 10 thus making a total of four different baluster lengths.

In creating an inventory that allows the manufacture of a 4 baluster per tread stairway system 10, 3 baluster per tread stairway system 10 and 2 baluster per tread stairway system 10, the inventory would include 6 unique baluster lengths. To create an inventory that allows the manufacture of a 5 baluster per tread stairway system 10, 4 baluster per tread stairway system 10, 3 baluster per tread stairway system 10 and 2 baluster per tread stairway system 10, the inventory would include 10 unique balusters lengths. To create an inventory that could accommodate 6, 5, 4, 3 or 2 balusters per tread, an inventory of 12 unique baluster lengths would be used. The number of balusters per tread might be extended further to higher numbers and in each case the minimum number of baluster lengths needed to accommodate the patterns to have the alignments of features 36 with the foot support surface 22 of the tread 12 and the handrail slope.

Figure 8:
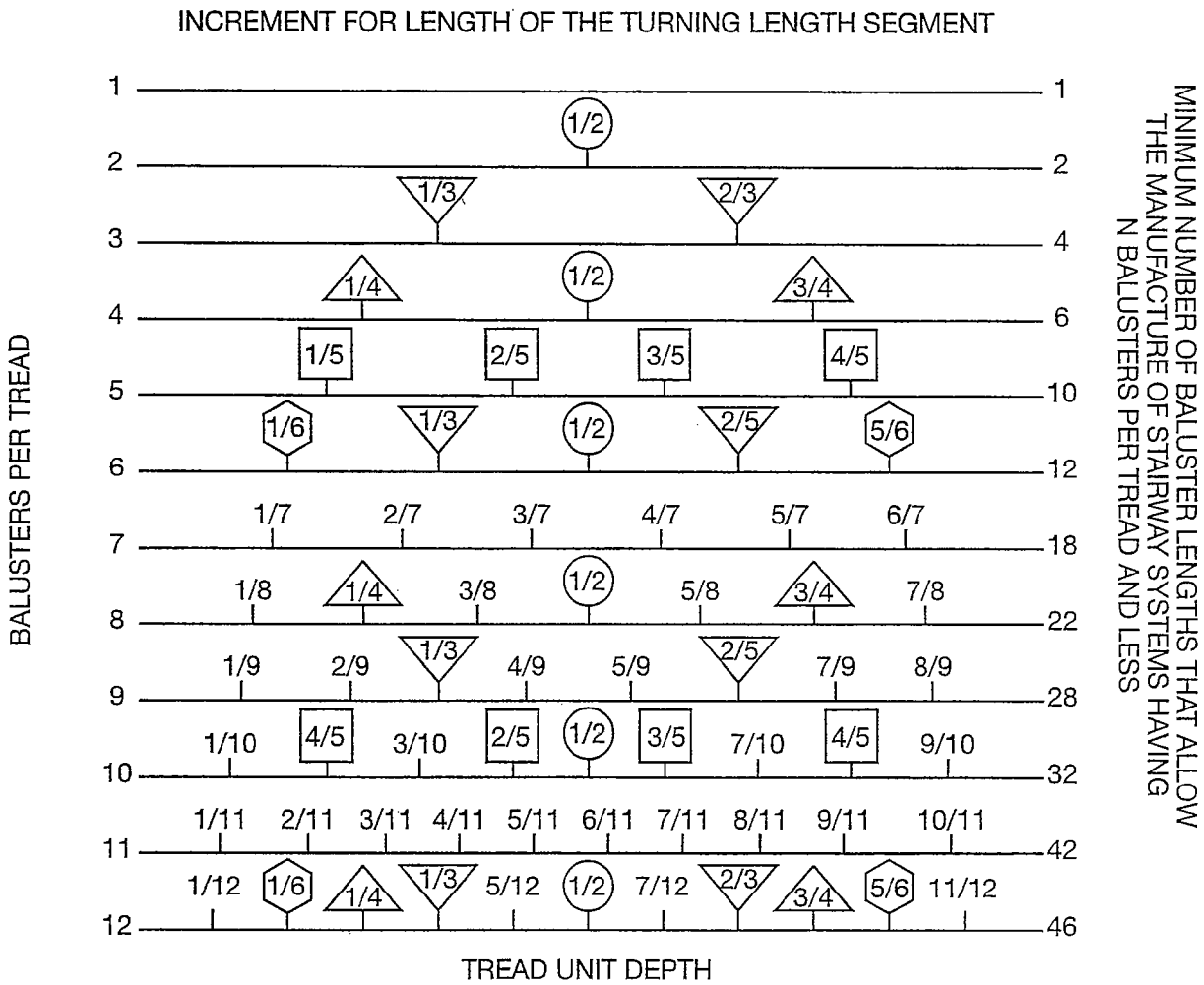
FIG. 8 illustrates the relationship among baluster along a tread for systems having from one baluster per tread to twelve balusters per tread according to the present invention.

For example as can be learned from the data of FIG. 8, inventories that would allow the manufacture of a 12 baluster per tread stairway system 10 and less has a minimum of 46 unique baluster lengths, inventories that would allow the manufacture of a 11 baluster per tread stairway system 10 and less has a minimum of 42 unique baluster lengths, inventories that would allow the manufacture of a 10 baluster per tread and less has a minimum of 32 unique baluster lengths, . . . etc. These variations will be determined by those skilled in the art. Typically, one is not interested in having more than about four balusters per tread.

The data of FIG. 8 may also be used to determine the number of unique balusters for inventories that would allow the manufacture of other ranges of balusters per tread, as shown in Table 1 below. For example, an inventory that would allow the manufacture of a stair system 10 having three balusters per tread through a stair system 10 having six baluster per tread would have 12 unique balusters having the desire features 36. Note that in FIG. 8, each baluster per tread stairway system 10 set-up starts with a first baluster that is not shown at the starting or zero position and the increment for the length of the turning length segment 32 of the subsequent balusters are those shown. When the increment for the length of the turning length segment 32 a baluster is in the same fractional position as a previous baluster per tread stairway system 10 setup it is surrounded by a similar shape to designate that it is redundant therewith. Specifically, in FIG. 8, circles, squares, triangles, inverted triangles, and hexagons are used to indicate duplicates.

TABLE 1

| NUMBER OF BALUSTERS/TREAD | TOTAL NUMBER OF UNIQUE & REDUNANT BALUSTERS | NUMBER OF UNIQUE BALUSTERS | NUMBER OF REDUNANT BALUSTERS |
|---|---|---|---|
| 1 | 1 | 1 | 0 |
| 2 | 3 | 2 | 1 |
| 3 | 6 | 4 | 2 |
| 4 | 10 | 6 | 4 |
| 5 | 15 | 10 | 5 |
| 6 | 21 | 12 | 9 |
| 7 | 28 | 18 | 10 |
| 8 | 36 | 22 | 14 |
| 9 | 45 | 28 | 17 |
| 10 | 55 | 32 | 23 |
| 11 | 66 | 42 | 24 |
| 12 | 78 | 46 | 32 |

Figure 5:
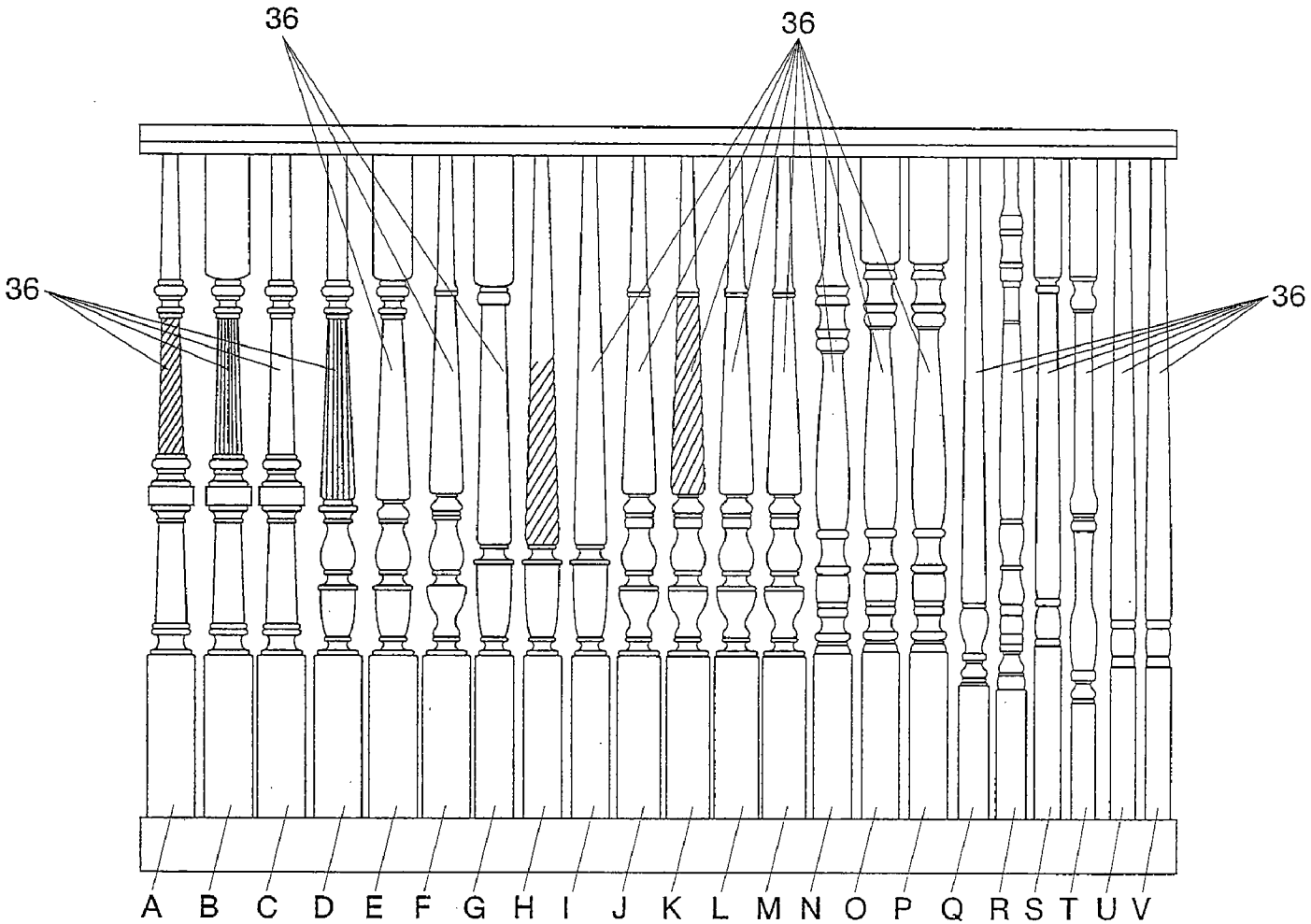
FIG. 5 illustrates various examples of turning length features useful according to the present invention.

FIG. 5 depicts and Table 2 below provides a description of a number of features in balusters A-V, the features being 36. For example, baluster A's features 36 corresponds to a Williamsburg Baluster with Pin Top, Roped Design & Architectural Square, where the top length segment 30 is that portion of the features 36 including the Pin Top; the bottom length segment 34 is that portion of the features 36 including the Architectural Square; and the turning length segment 32 is that portion of the features 36 including the Roped Design. As another example, baluster Q's features 36 corresponds to a Baluster with Pin Top, Plain Design & Vases, where the top length segment 30 is that portion of the features 36 including the Pin Top; the bottom length segment 34 is that portion of the features 36 including the Vases; and the turning length segment 32 is that portion of the features 36 including the Plain Design.

For the at least two balusters 16 including a first baluster 26 and a second baluster 28 according to the present invention, there are portions of the features 36 that align with the tread 12 to which the at least two balusters 16 communicate and portions of the features 36 that align with the slope of the handrail. This alignment is facilitated by incrementally changing the length of the turning length segment 32 of the second baluster 28 and any subsequent baluster by an increment that is an integer multiple of the ratio RH/N, where RH is the riser height and N is the number of balusters per tread. Adding this integer increment to the reference length, $T_nL_o$, of the turning length segment 32 of the first baluster to generate the length of the turning length segment 32 of subsequent balusters accommodates the alignment of portions of the features 36 in the bottom length segment 34 of the balusters with the tread 12 to which the subsequent balusters communicate and portions of the features 36 in the top length segment 30 of the balusters with the slope of the handrail 14.

TABLE 2

| BALUSTER DESIGNATION AS SHOWN IN FIG. 5 | BALUSTER FEATURE DESCRIPTION |
|---|---|
| A | Williamsburg Baluster with Pin Top, Roped Design & Architectural Square |
| B | Williamsburg Baluster with Square Top, Fluted Design & Architectural Square |
| C | Williamsburg Baluster with Pin Top, Plain Design & Architectural Square |
| D | 1800's Baluster with Pin Top, Reeded Design & Stacked Vases |
| E | 1800's Baluster with Square Top, Plain Design & Stacked Vases |
| F | 1800's Baluster with Pin Top, Octagonal Design & Stacked Vases |
| G | Carolina Baluster with Square Top, Plain Design & Elongated Vase |
| H | Carolina Baluster with Pin Top, Twist Design & Elongated Vase |
| I | Carolina Baluster with Pin Top Fluted Design & Elongated Vase |
| J | Jefferson Baluster with Pin Top, Fluted Design & Inverted Vase |
| K | Jefferson Baluster with Pin Top, Roped Design & Inverted Vase |
| L | Jefferson Baluster with Pin Top, Octagonal Design & Inverted Vase |
| M | Jefferson Baluster with Pin Top, Plain Design & Inverted Vase |
| N | Hampton Baluster with Pin Top, Plain Design & Stacked Vases |
| O | Hampton Baluster with Square Top, Plain Design & Stacked Vases |
| P | Hampton Baluster with Square Top, Plain Design & Stacked Vases |
| Q | Baluster with Pin Top, Plain Design & Vases |
| R | Hampton Baluster with Pin Top, Plain Design & Stacked Vases |
| S | Baluster with Square Top, Plain Design & Vases |
| T | Baluster with Square Top, Plain Design & Elongated Vase |
| U | Baluster with Pin Top, Plain Design & Vase |
| V | Baluster with Pin Top, Plain Design & Vase |

In creating the stairway system 10 of the present invention, it is advantageous to anchor it to various portions of a structure. FIG. 6A depicts the anchoring of an uptight lateral support 20 to a tread 12 by means of an anchor 42. In this case the anchor 42 includes a bolt 44, a plate 52, a mounting column 46 which is in communication with the plate 52 to create a biasing of the plate 52 against the bottom of the tread 12, and the bolt 44 has on its other end a wood screw 50 which engages the upright lateral support 20 to create a firm attachment of the handrail 14 to the tread 12.

Figure 6B:
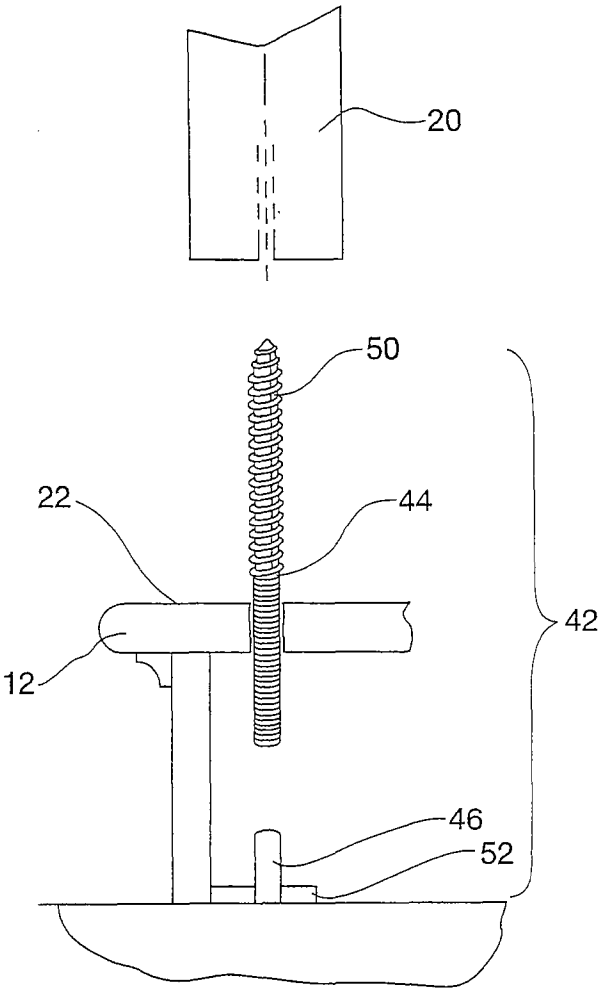
FIG. 6B is the anchoring system of FIG. 6A showing it floor mounted.
Figure 6A:
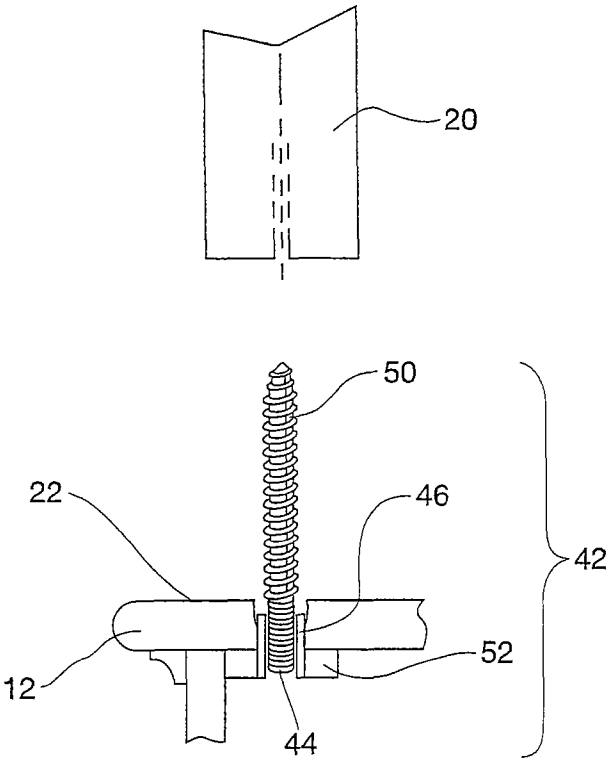
FIG. 6A is an anchoring system according to the preferred embodiment of the present invention showing it tread mounted.

An alternative method of using the anchor 42 is as shown in FIG. 6B. In this case, the plate 52 including the mounting column 46 is fastened to the floor and the bolt 44 has a length such that it can extend through the tread 12 into the mounting column 46 over the riser height. Then the wood screw end 50 engages the upright lateral support 20.

Figure 7:
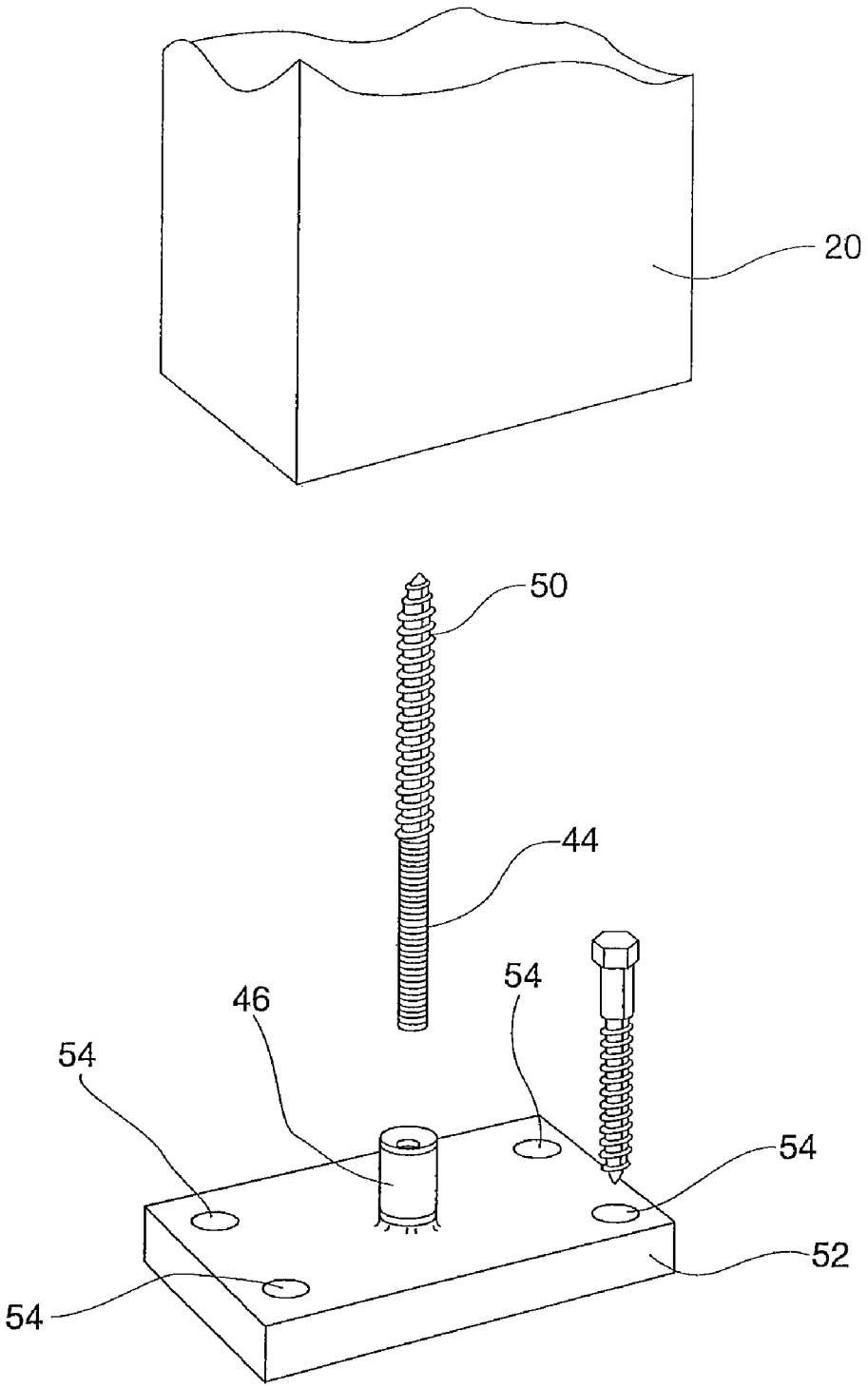
FIG. 7 is an exploded view of the anchor system of FIGS. 6A and 6B.

A more detailed drawing of the flexible anchor 42 is shown in FIG. 7. Here it is seen that the plate 52 can include apertures for attaching the plate 52 either to the floor by use of for example, a fastener such as a wood bolt, or alternatively to the bottom of a tread 12. Again there is the bolt 44 that engages the mounting column 46 and a wood screw end 50 that engages the upright lateral support 20. Although not depicted in FIG. 7, there could be a tread 12 placed between the upright lateral support 20 and the plate 52 and as previously described the plate 52 can either be in contact with the tread 12 or mounted directly to the floor.

Certain modifications and improvements will occur to those skilled in the art upon a reading of the foregoing description. For example, other methods may be available for anchoring the stairway system 10 of the present invention including, for example, a newel post fastener system having a bolt extending into the newel and a access hole and with a threaded sleeve into which a nut may be inserted (see e.g., part #3072 available from Crown Heritage Stair Systems of North Wilkesboro, N.C., the subject matter of which is incorporated herein in its entirety). It should be understood that all such modifications and improvements have been deleted herein for the sake of conciseness and readability but are properly within the scope of the following claims.

I claim:

1. Materials for assemblage into a handrail assembly for a stairway having treads, the materials comprising:

(a) a handrail comprising a bottom surface;

(b) a baluster inventory consisting of a first, second, third, and fourth baluster, each of the balusters having an overall length dimension between about 31 inches to about 46 inches that is unique to the overall length dimension of the other three balusters, a bottom segment having a length substantially the same as the length of the bottom segment of the other three balusters, a turning segment having a length dimension unique to the length dimension of the turning segment of the other three balusters, and a top segment with a length substantially the same as the length of the top segment of the other three balusters greater than zero, whereby said baluster inventory can be assembled into a handrail assembly having evenly spaced balusters, between two and three balusters per stairway tread having substantially uniform bottom segment lengths, and substantially uniform top segment lengths parallel to the handrail.

* * * * *